US012366129B2

(12) United States Patent
Nofal

(10) Patent No.: US 12,366,129 B2
(45) Date of Patent: Jul. 22, 2025

(54) SPACER SPOOL WITH RETURN LINE TO CONNECT RIG BLOW OUT PREVENTOR TO MANAGED PRESSURE DRILLING CHOKE

(71) Applicant: SAUDI ARABIAN OIL COMPANY, Dhahran (SA)

(72) Inventor: Ahmed Mokhtar Abdelrehim Nofal, Cairo (EG)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/465,615

(22) Filed: Sep. 12, 2023

(65) Prior Publication Data

US 2025/0084714 A1 Mar. 13, 2025

(51) Int. Cl.
*E21B 21/08* (2006.01)
*E21B 33/08* (2006.01)

(52) U.S. Cl.
CPC ..... *E21B 21/08* (2013.01); *E21B 33/085* (2013.01)

(58) Field of Classification Search
CPC ..... E21B 21/08; E21B 33/085; E21B 34/02; E21B 34/16; E21B 33/03; E21B 33/06; E21B 34/00
See application file for complete search history.

(56) References Cited

U.S. PATENT DOCUMENTS

| | | | | |
|---|---|---|---|---|
| 10,329,860 | B2 | 6/2019 | Boutalbi et al. | |
| 2003/0221838 | A1* | 12/2003 | Dallas | E21B 33/068 166/381 |
| 2017/0145764 | A1* | 5/2017 | Boutalbi | E21B 33/085 |
| 2020/0332609 | A1* | 10/2020 | Bryant | E21B 19/155 |

FOREIGN PATENT DOCUMENTS

AU 2011303956 B2 11/2015

OTHER PUBLICATIONS

Grayson, Richard et al., "Nabors develops MPD Return Flow Pathways procedure to manage non-well control use of rig chokes"; Drilling Contractor; Oct. 24, 2019; <https://drillingcontractor.org/nabors-develops-mpd-return-flow-pathways-procedure-to-manage-non-well-control-use-of-rig-chokes-54306>; Accessed Sep. 11, 2023 (8 pages).

China National Petroleum Corporation, "CQMPD-1 Precise Managed Pressure Drilling (MPD) System"; Science & Technology Management Department, CNPC; 2015; <http://www.cnpc.com.cn/cnpc2015/gcdx/201507/69bbca634019405483fc75c6eed3ddc0/files/90efaa7bd2744c3aa64d8e1d1245a459.pdf>; Accessed Sep. 11, 2023 (24 pages).

* cited by examiner

*Primary Examiner* — Caroline N Butcher
(74) *Attorney, Agent, or Firm* — Osha Bergman Watanabe & Burton LLP

(57) ABSTRACT

A system includes a rotating control device (RCD), a managed pressure drilling (MPD) choke, a blowout preventor (BOP), a component in the blowout preventor (BOP), and a drilling spool. The RCD is installed on the wellbore, seals an annulus of the wellbore, and provides a MPD flow path from the annulus of the wellbore to the MPD choke. The MPD choke is configured to apply a back pressure on the wellbore to drill the wellbore using a MPD technique. The BOP is installed downhole from the RCD on the wellbore. The component located in the BOP is configured to close to prevent mud from flowing to RCD. The drilling spool installed downhole from the component in the BOP has a MPD choke line outlet configured to provide a MPD alternate flow path from the annulus of the wellbore to the MPD choke when the component is closed.

20 Claims, 4 Drawing Sheets

SPACER SPOOL WITH RETURN LINE TO CONNECT RIG BLOW OUT PREVENTOR TO MANAGED PRESSURE DRILLING CHOKE

BACKGROUND

Hydrocarbons are found in porous rock formations located beneath the Earth's surface. Wells are drilled into the rock formations to access and produce the hydrocarbons. Wells are drilled using a drill string and a mud system. The drill string includes a drill bit. The drill string rotates and applies pressure on the drill bit to break down the rock. Mud is pumped through the drill string to remove broken-down rock and lubricate the drill bit. The mud is also used to manage downhole/wellbore pressures.

Wellbore pressure must be properly managed to prevent well control incidents. Conventional pressure management operates in an open-vessel system, meaning that the mud exits the top of the wellbore open to the atmosphere. Thus, wellbore pressure can only be managed using the density and flow rate of the mud. Conventional pressure management has various limitations in controlling wellbore pressure and prevents wellbore pressures from being adequately monitored unless the well is shut in.

In some applications, the drilling window is large enough that conventional pressure management is adequate. However, in narrow drilling window applications, such as in offshore drilling, conventional pressure management is inadequate and can pose various risks. As such, managed pressure drilling (MPD) may be used in place of conventional pressure management. In MPD, the drilling mud circulates in a closed system, and specific equipment is used to apply back pressure to the wellbore. The back pressure is controllable and used to manage downhole pressure.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, methods and systems for drilling a well. The system includes a rotating control device, a managed pressure drilling choke, a blowout preventor, a component located in the blowout preventor, and a drilling spool. The rotating control device is installed on the wellbore and configured to seal an annulus of the wellbore. The rotating control device is further configured to provide a managed pressure drilling flow path from the annulus of the wellbore to the managed pressure drilling choke. The managed pressure drilling choke is configured to partially close to apply a back pressure on the wellbore to drill the wellbore using a managed pressure drilling technique. The blowout preventor is installed downhole from the rotating control device on the wellbore. The component located in the blowout preventor is configured to close to prevent mud from flowing to the rotating control device. The drilling spool installed downhole from the component in the blowout preventor has a managed pressure drilling choke line outlet configured to provide a managed pressure drilling alternate flow path from the annulus of the wellbore to the managed pressure drilling choke when the component is closed.

The method includes providing a managed pressure drilling flow path from an annulus of the wellbore to a managed pressure drilling choke by installing a rotating control device on the wellbore and sealing the annulus of the wellbore using the rotating control device. The method also includes drilling the wellbore using a managed pressure drilling technique by applying a back pressure on the wellbore using the managed pressure drilling choke and the managed pressure drilling flow path. The method also includes closing a component in a blowout preventor installed downhole from the rotating control device on the wellbore and providing a managed pressure drilling alternate flow path from the annulus of the wellbore to the managed pressure drilling choke by opening a managed pressure drilling choke line outlet on a drilling spool installed downhole from the component in blowout preventor. The method further includes drilling or controlling the wellbore using the managed pressure drilling technique by applying the back pressure on the wellbore using the managed pressure drilling choke and the managed pressure drilling alternate flow path when the component is closed.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
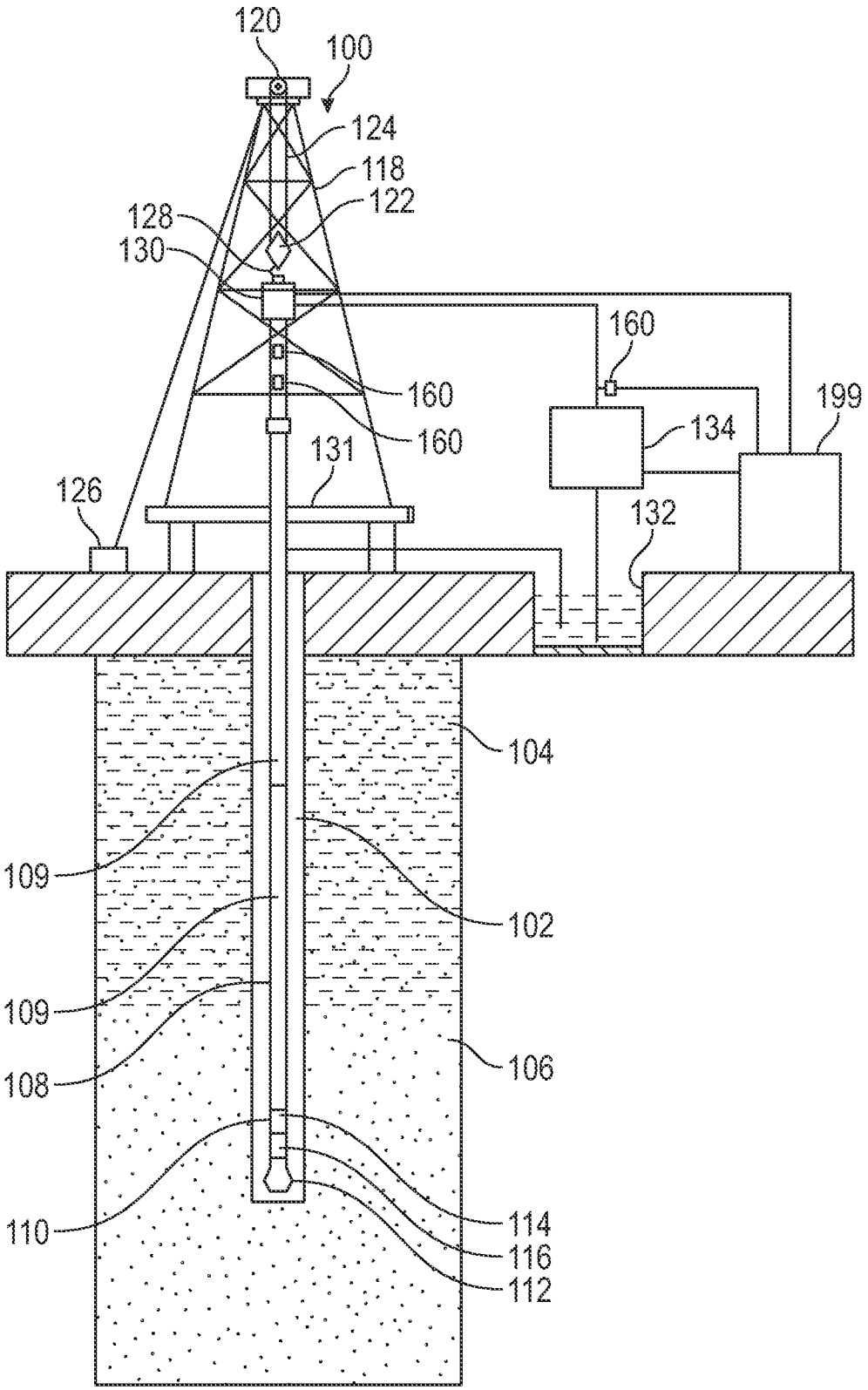
FIG. 1 shows a well site in accordance with one or more embodiments.

FIG. 1 shows a well site (100) in accordance with one or more embodiments. The well site (100) shown in FIG. 1 is used herein as an example well site. Well sites may be configured in a myriad of ways; therefore, the well site (100) is not intended to be limiting with respect to the particular configuration of the drilling equipment. The well site (100) is depicted as being on land. In other examples, the well site (100) may be offshore, and drilling may be carried out with or without use of a marine riser. A drilling operation at well site (100) may include drilling a wellbore (102) into a subsurface including various formations (104, 106). For the purpose of drilling a new section of wellbore (102), a drill string (108) is suspended within the wellbore (102).

The drill string (108) may include one or more drill pipes (109) connected to form conduit and a bottom hole assembly (BHA) (110) disposed at the distal end of the conduit. The BHA (110) may include a drill bit (112) to cut into the subsurface rock. The BHA (110) may include measurement tools, such as a measurement-while-drilling (MWD) tool (114) and logging-while-drilling (LWD) tool 116. Measurement tools (114, 116) may include sensors and hardware to measure downhole drilling parameters, and these measurements may be transmitted to the surface using any suitable telemetry system known in the art. The BHA (110) and the drill string (108) may include other drilling tools known in the art but not specifically shown.

The drill string (108) may be suspended in wellbore (102) by a derrick (118). A crown block (120) may be mounted at the top of the derrick (118), and a traveling block (122) may hang down from the crown block (120) by means of a cable or drilling line (124). One end of the cable (124) may be connected to a draw works (126), which is a reeling device that can be used to adjust the length of the cable (124) so that the traveling block (122) may move up or down the derrick (118).

The traveling block (122) may include a hook (128) on which a top drive (130) is supported. The top drive (130) is coupled to the top of the drill string (108) and is operable to rotate the drill string (108). Alternatively, the drill string (108) may be rotated by means of a rotary table (not shown) on the drilling floor (131). Drilling fluid (commonly called mud) may be stored in a mud pit (132), and at least one pump (134) may pump the mud from the mud pit (132) into the drill string (108). The mud may flow into the drill string (108) through appropriate flow paths in the top drive (130) (or a rotary swivel, if a rotary table is used instead of a top drive to rotate the drill string (108)).

In one implementation, a system (199) may be disposed at or communicate with the well site (100). The system (199) may control at least a portion of a drilling operation at the well site (100) by providing controls to various components of the drilling operation. In one or more embodiments, system (199) may receive data from one or more sensors (160) arranged to measure controllable parameters of the drilling operation. As a non-limiting example, sensors (160) may be arranged to measure WOB (weight on bit), RPM (drill string rotational speed), GPM (flow rate of the mud pumps), and ROP (rate of penetration of the drilling operation).

Sensors (160) may be positioned to measure parameter(s) related to the rotation of the drill string (108), parameter(s) related to travel of the traveling block (122), which may be used to determine ROP of the drilling operation, and parameter(s) related to flow rate of the pump (134). For illustration purposes, sensors (160) are shown on drill string (108) and proximate mud pump (134). The illustrated locations of sensors (160) are not intended to be limiting, and sensors (160) could be disposed wherever drilling parameters need to be measured. Moreover, there may be many more sensors (160) than shown in FIG. 1 to measure various other parameters of the drilling operation. Each sensor (160) may be configured to measure a desired physical stimulus.

During a drilling operation at the well site (100), the drill string (108) is rotated relative to the wellbore (102), and weight is applied to the drill bit (112) to enable the drill bit (112) to break rock as the drill string (108) is rotated. In some cases, the drill bit (112) may be rotated independently with a drilling motor. In further embodiments, the drill bit (112) may be rotated using a combination of the drilling motor and the top drive (130) (or a rotary swivel if a rotary table is used instead of a top drive to rotate the drill string (108)).

While cutting rock with the drill bit (112), mud is pumped into the drill string (108). The mud flows down the drill string (108) and exits into the bottom of the wellbore (102) through nozzles in the drill bit (112). The mud in the wellbore (102) then flows back up to the surface in an annular space between the drill string (108) and the wellbore (102) with entrained cuttings. The mud with the cuttings is returned to the pit (132) to be circulated back again into the drill string (108). Typically, the cuttings are removed from the mud, and the mud is reconditioned as necessary, before pumping the mud again into the drill string (108). In one or more embodiments, the drilling operation may be controlled by the system (199).

In managed pressure drilling (MPD) operations, the drilling mud is circulated into the wellbore (102) through the drill string (108) and exits the annulus of the wellbore (102) through a rotating control device (RCD) located above the blow out preventor (BOP). The RCD is integrated into the MPD closed loop system.

However, when the BOP is closed, the drilling mud can no longer be circulated above the BOP. When the drilling mud can no longer be circulated above the BOP, the drilling mud is unable to enter the MPD closed loop system through the RCD. This means that the MPD operation can no longer occur, and conventional wellbore (102) pressure management must be used instead (i.e., relying on the flow rate and mud weight). This can be dangerous when drilling pressure windows are narrow.

There are many scenarios that prevent circulation above the BOP. For example, when an acid job is performed on the wellbore, the acid cannot be circulated through the BOP or RCD because the acid will damage those components. Furthermore, the RCD connection may leak or the MPD bearing may fail which would require the well to be killed and fluid communication above the BOP to be cut off in order to repair the leak. In other scenarios, the well may receive a volume of fluids that creates a pressure beyond the maximum limit of the RCD and circulation would have to be stopped above the BOP.

Thus, it is beneficial to have the ability to continue to perform an MPD operation when circulation above the BOP is prevented. As such, embodiments disclosed herein outline MPD systems and methods that use a modified drilling spool located in the BOP to circulate drilling mud from the annulus of the wellbore (102) to the MPD closed loop system when circulation above the BOP is prevented.

Figure 2:
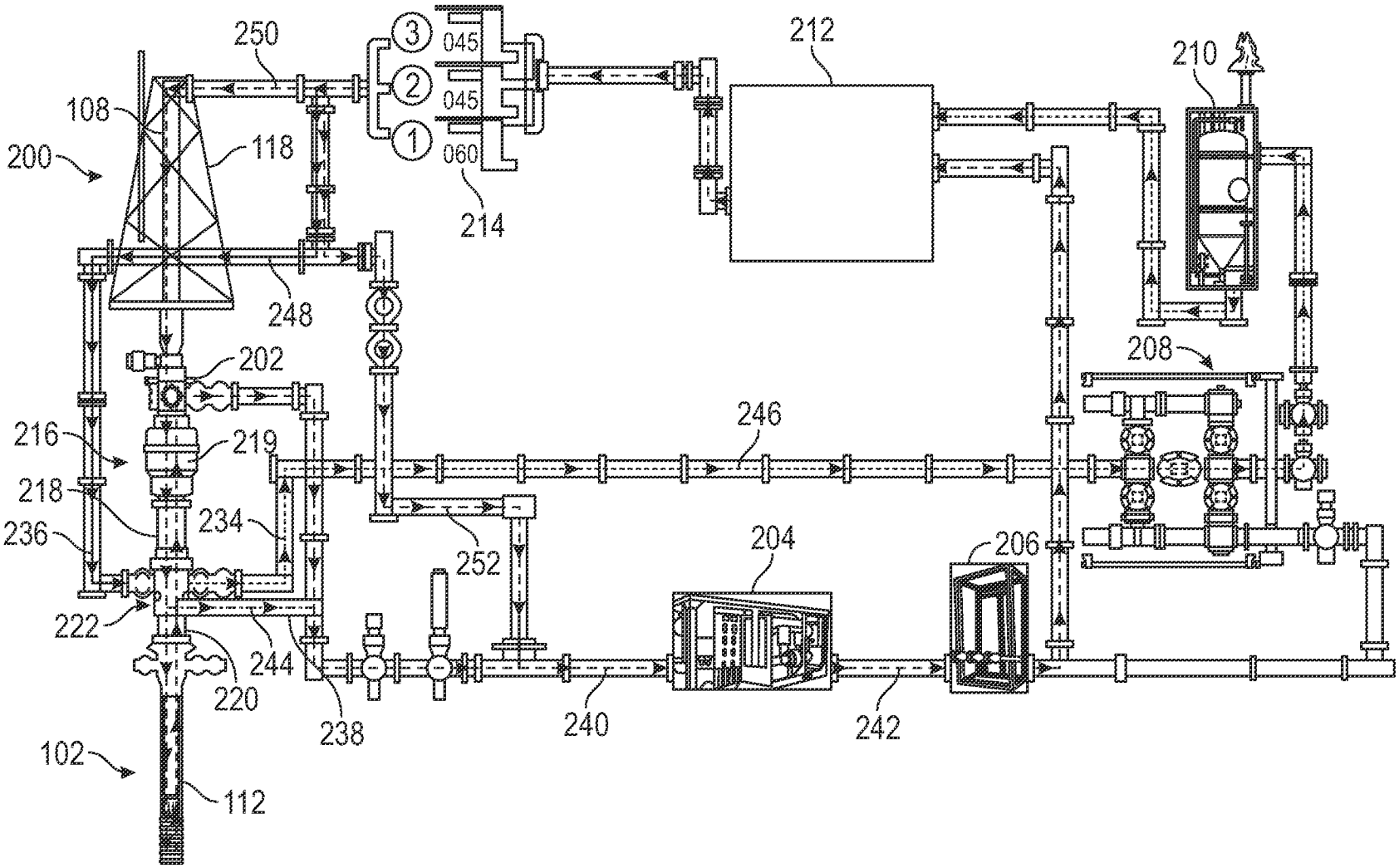
FIG. 2 shows a diagram of a managed pressure drilling system in accordance with one or more embodiments.

FIG. 2 shows a diagram of an MPD system (200) in accordance with one or more embodiments. Components shown in FIG. 2 that are the same as or similar to components shown in FIG. 1 have not been re-described for purposes of readability and have the same description and function as outlined above.

In accordance with one or more embodiments, the MPD system (200) shown in FIG. 2 is used in a well site, such as the well site (100) outlined in FIG. 1, to manage the pressures in the wellbore (102). Specifically, the MPD system (200) is used to provide a closed-loop circulation system in which pore pressure, formation fracture pressure, and bottom hole pressure are balanced and managed at the surface. In accordance with one or more embodiments, the MPD system (200) uses an RCD (202) at the outlet of the annulus of the well to enable the circulation system to be in a closed loop. Specifically, the RCD (202) seals the annulus around the drill string (108) during drilling and reciprocating using an MPD bearing.

The MPD system (200) manages the pressures using an MPD choke (204) located downstream of the mud exiting the wellbore (102). In accordance with one or more embodiments, the MPD choke (204) is a choke manifold having a series of piping and one or more special valves, called choke valves. The choke valves can be manually or automatically controlled without departing from the scope of the disclosure herein.

The choke valves are able to move from a fully closed position to a fully opened position. In accordance with one or more embodiments, the position of a choke valve is measured by a percentage. For example, 100% may represent when the valve is in a fully opened position, 50% may represent when the choke valve is halfway closed, and 0% may represent when the choke valve is fully closed. These percentages may also relate to the amount of flow allowed through the choke valve.

The MPD choke (204) "chokes" the mud flow by partially closing one or more of the choke valves. That is, the choke valves in the MPD choke (204) may be closed to allow for any percentage of flow from 100% to 0% of the flow capacity. When the choke valves are partially closed (i.e., less than 100%), the flow rate of the mud flowing through the MPD choke (204) is reduced. Reduction of flow through the MPD choke (204) causes a back pressure to be applied to the mud flow located upstream from the MPD choke (204).

Because the MPD choke (204) is located downstream of the exit of the wellbore (102), this back pressure is applied to the annulus of the wellbore (102). The amount of pressure applied in the wellbore (102) may then be controlled by the percent closure of the choke valves in the MPD choke (204). For example, to apply a higher pressure in the annulus of the wellbore (102), the choke valves in the MPD choke (204) should be closed more (i.e., the percentage of flow through the choke valve reduced).

Other components that are part of the MPD system (200), and as shown in FIG. 2 include an MPD flow meter (206), a rig choke (208), a rig separator (210), a mud conditioning system (212), mud pumps (214), a drill string (108), a derrick (118), and a blowout preventor (BOP) (216). The rig separator (210) is a mud-gas separator that is used to separate gas from the drilling mud. Specifically, the rig separator (210) is used to separate gas from the mud at the outlet of the rig choke (208). The MPD flow meter (206) is used to measure flow rate, mud weight, and temperature of the mud at the outlet of the MPD choke (204).

The mud conditioning system (212) includes any and all equipment required to condition the drilling mud to the specification of the drilling operation. For example, the mud conditioning system (212) may include shale shakers, mud pits, mixers, desilters, desanders, etc. The specific components included in the mud conditioning system (212) depend on the application of the MPD system (200), the drilling operation requirements, and the formations through which the wellbore (102) is being drilled.

The mud pumps (214) are used to pump the drilling mud through the standpipe line (250) and into the drill string (108) at a designated flow rate. The FIG. 2 shows the MPD system (200) having three mud pumps (214); however, any number and type of mud pumps (214) may be used depending on the flow rate requirements and available pump specifications.

The rig choke (208) is a choke manifold having a series of piping and special valves, called choke valves, used to circulate the drilling mud when the BOP (216) is closed and when the drilling mud is not being diverted into the MPD choke (204) via the BOP (216). The rig choke (208) is primarily used in well control. Specifically, the rig choke (208) is used to control downhole pressures and circulate out a kick. The rig choke (208) may also be used for other purposes, such as well testing, without departing from the scope of the disclosure herein.

The primary difference between the rig choke (208) and the MPD choke (204) is the purpose that they each serve and their location within the MPD system (200). The MPD choke (204) is to be used while drilling the wellbore (102) to manage the downhole pressures and the rig choke (208) is to be used in a well control incident to manage kick pressures and circulate out a kick.

The BOP (216) is a series of spools and rams that is used to control a well control incident. Specifically, the BOP (216) is used to block off the top of the wellbore (102) to prevent a kick from uncontrollably traveling to the surface through the wellbore (102). As such, the BOP (216) is situated on the surface, connected to the wellhead, and located between the wellhead and the rig floor.

The BOP (216) may have any design known in the art. The specific design and rating of the BOP (216) depends on the drilling operation and the pressures of the formation through which the wellbore (102) is being drilled. For example, the BOP (216) may have a combination of pipe rams, blind rams, shear rams, and blind shear rams operated using hydraulic hoses and accumulators.

In accordance with one or more embodiments, the pipe ram is used to close the annular space between the pipe and the BOP (216). In accordance with one or more embodiments the pipe ram may be an annular ram (219) that is configured to be closed around any size of tubular. In other embodiments, there may be multiple pipe rams of different sizes depending on the size of pipes that may be run into the wellbore (102). For example, there may be a pipe ram that is sized to be closed around the drill string (108). There may also be a pipe ram that is sized to close around a casing string in situations where a kick may occur when running in casing.

A blind ram has no opening for tubing and closes the well by completely blocking the conduit of the wellbore (102) when there is no drill string (108) in the well. A shear ram is decided to cut through a pipe. A blind shear ram can function as both a blind ram and a shear ram. FIG. 2 shows the BOP (216) having an annular ram (219), a double ram (218), and a lower pipe ram (220). In accordance with one or more embodiments, the double ram (218) includes two types of any of the rams listed above. The lower pipe ram (220) is a pipe ram as outlined above. In accordance with one or more embodiments, circulation above the BOP (216) may be cut off when one of the rams in the double ram (218) is closed.

FIG. 2 further shows a modified drilling spool (222) included in the BOP (216). The drilling spool (222) is a specially designed spacer spool that allows for the MPD system (200) to operate when the BOP (216) is fully open as well as when portions of the BOP (216) are closed. In accordance with one or more embodiments, the drilling spool (222) is located in the BOP (216) stack below the double ram (218) and above the lower pipe ram (220). The drilling spool (222) is outlined in FIGS. 3*a* and 3*b*, below.

Figure 3B:
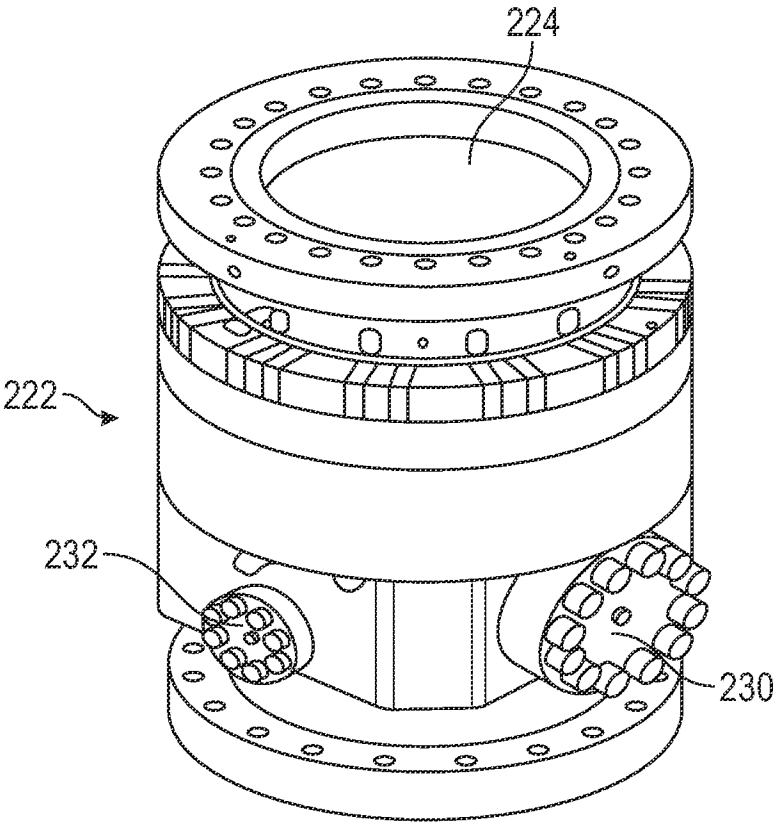
FIGS. 3*a* and 3*b* show a drilling spool in accordance with one or more embodiments.
Figure 3A:
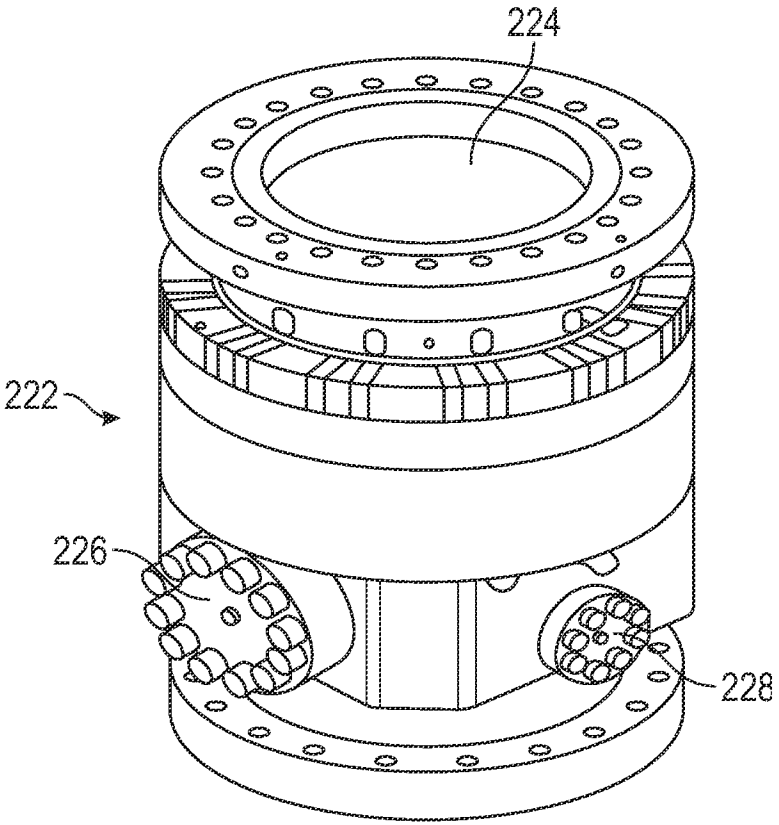

FIGS. 3*a* and 3*b* show a drilling spool (222) in accordance with one or more embodiments. Specifically, FIG. 3*a* shows a first side view of the drilling spool (222) and FIG. 3*b* shows a second side view of the drilling spool (222). In accordance with one or more embodiments, the first side view and the second side view are located on opposite sides of the drilling spool (222) from one another.

The drilling spool (222) is a tubular that is connected to components of the BOP (216). The drilling spool (222) may be connected to components of the BOP (216) using any connection known in the art, such as a bolted connection, as seen in FIGS. 3*a* and 3*b*, a welded connected, a threaded connection, etc. The drilling spool (222) may be made out of any material known in the art that can withstand the corrosive properties, temperatures, and pressure seen in drilling operations, such as a steel alloy.

The drilling spool (222) has a conduit (224) through which the drilling mud may flow within. The drilling spool (222) is manufactured with three outlets and one inlet, a rig choke line outlet (226), a bleed off line outlet (228), an MPD choke line outlet (230), and a kill line inlet (232). The outlets and inlet are each formed into the sidewall of the drilling spool (222). The outlets and inlet are configured to be connected to another tubular.

Thus, the outlets and the inlet are manufactured with a connection, such as a bolted connection, that corresponds to a connection on a secondary tubular. The three outlets may be used to allow the mud to flow out of the drilling spool (222) and the inlet may be used to allow the mud to flow into the drilling spool (222).

In accordance with one or more embodiments, the drill string (108) may be disposed within the conduit (224) of the drilling spool (222) when the drill string (108) is deployed in the wellbore (102). Thus, mud exiting or entering the drilling spool (222) is exiting or entering the annulus formed between the drill string (108) and the drilling spool (222).

Turning back to FIG. 2, the rig choke line outlet (226) allows the mud to flow from the drilling spool (222) to the rig choke (208) via a rig choke line (234). A valve, not pictured, may be positioned on the rig choke line (234) to control the flow of mud from the drilling spool (222) to the rig choke (208). The bleed off line outlet (228) allows the mud to flow from the drilling spool (222) to a bleed off line (not pictured).

The kill line inlet (232) allows the mud to flow from the mud pumps (214) into the well via a kill line (236), bypassing the drill string (108). A valve, not pictured, may be positioned along the kill line (236) to control the flow of mud from the mud pumps (214) to the drilling spool (222). The MPD choke line outlet (230) enables the mud to flow from the drilling spool (222) to the MPD choke (204) using an MPD alternate line (238) connected to the MPD primary line (240). A valve, not picture, may be positioned along the MPD alternate line (238) to control the flow of mud from the drilling spool (222) to the MPD choke (204).

The rig choke line (234), the bleed off line, the kill line (236), and the MPD alternate line (238) may have connections that correspond with the connections on the corresponding outlets/inlet of the drilling spool (222). Furthermore, the aforementioned lines may be a series of tubular connected to one another. The tubulars may be made out of any material known in the art, such as a steel alloy.

FIG. 2 shows four potential mud flow paths through the MPD system (200). A person skilled in the art will appreciate that these flow paths are used as an example of how the drilling spool (222) is used to circulate mud and may be modified depending on the application. Furthermore, other flow paths may exist in the MPD system (200) without departing from the scope of the disclosure herein.

In particular, FIG. 2 shows an MPD flow path (242), an MPD alternate flow path (244), a rig choke flow path (246), and a kill flow path (248). In accordance with one or more embodiments, the MPD flow path (242) is the flow path the mud takes in normal (i.e., above the BOP (216) circulation) MPD operations. In the MPD flow path (242), all rams in the BOP (216) are open and the MPD choke line outlet (230) of the drilling spool (222), as well as every other outlet/inlet of the drilling spool (222), is closed.

In the MPD flow path (242), the mud flows from the mud conditioning system (212) to the mud pumps (214). The mud pumps (214) pump the mud through the standpipe line (250) and into the inside of the drill string (108). The mud flows out of the drill string (108) into the annulus of the wellbore (102) through the drill bit (112). The mud travels to the top of the well and exits the wellbore (102) through the RCD (202) above the BOP (216). From the RCD (202), the mud travels along the MPD primary line (240) to the MPD choke (204) and the MPD flow meter (206). At this point, the mud flows back to the mud conditioning system (212) and is recirculated.

In accordance with one or more embodiments, the mud does not flow through the rig choke (208) when flowing along the MPD flow path (242) unless high gases are present. In such scenarios, the MPD flow path (242) includes pumping the mud through the rig choke (208) to separate the gases using the rig separator (210).

In accordance with one or more embodiments, the MPD system (200) includes an MPD auxiliary line (252). In the MPD flow path (242), the MPD auxiliary line (252) is used to circulate mud from the mud pumps (214) to the MPD primary line (24) to keep back pressure on the well when making drill pipe connections on the drill string (108).

Specifically, when drill pipe connections are being made, there is no mud circulation through the drill string (108). As such, when a connection is being made, the mud is diverted through the MPD auxiliary line (252) to control the well using back pressure from the MPD choke (204). Once the connection is made, the flow is diverted from the MPD auxiliary line (252) back through the drill string (108).

The MPD alternate flow path (244) is the path that the mud follows to allow for MPD when circulation above the BOP (216) is prevented. In the MPD alternate flow path (244), one or more of the rams in the BOP (216) are closed and the MPD choke line outlet (230) of the drilling spool (222) is open. Furthermore, the rig choke line outlet (226), the bleed off line outlet (228), and the kill line inlet (232) of the drilling spool (222) are closed.

In the MPD alternate flow path (244), the mud flows from the mud conditioning system (212) to the mud pumps (214). The mud pumps (214) pump the mud through the standpipe line (250) and into the inside of the drill string (108). The mud flows out of the drill string (108) into the annulus of the wellbore (102) through the drill bit (112). The mud travels up the annulus to the BOP (216).

Because of the closure of the rams in the BOP (216), the mud is unable to flow through the annulus of the BOP (216) to the RCD (202) and the mud flow is diverted into the MPD alternate line (238) via the MPD choke line outlet (230) of the drilling spool (222). The MPD alternate line (238) is connected to the MPD primary line (240) allowing the mud to flow from the drilling spool (222) to the MPD choke (204) and MPD flow meter (206). At this point, the mud flows back to the mud conditioning system (212) and is recirculated.

The rig choke flow path (246) is the path that the mud follows when a well control incident occurs, and a kick is being circulated out of the wellbore (102) using the drill string (108). In the rig choke flow path (246), one or more of the rams in the BOP (216) are closed and circulation above the BOP (216) is prevented. Furthermore, the rig choke line outlet (226) of the drilling spool (222) is open and the bleed off line outlet (228), the kill line inlet (232), and the MPD choke line outlet (230) of the drilling spool (222) are closed.

In the rig choke flow path (246), the mud flows from the mud conditioning system (212) to the mud pumps (214). The mud pumps (214) pump the mud through the standpipe line (250) and into the inside of the drill string (108). The mud flows out of the drill string (108) into the annulus of the wellbore (102) through the drill bit (112). The mud travels up the annulus to the BOP (216).

Because of the closure of the rams in the BOP (216), the mud is unable to flow through the annulus of the BOP (216) to the RCD (202) and the mud flow is diverted into the rig choke line (234) via the rig choke line outlet (226) of the drilling spool (222). The mud flows through the rig choke line (234) to the rig choke (208) and the rig separator (210). At this point, the mud flows back to the mud conditioning system (212) and is recirculated.

The kill flow path (248) is the path that the mud follows when a well control incident occurs, and the drill string (108) is inaccessible, or the drill string (108) is not deployed in the wellbore (102). The kill line (236) is connected to the standpipe line (250), as shown in FIG. 2, or directly connected to the mud pumps (214). In the kill flow path (248), one or more rams in the BOP (216) is closed, the kill line inlet (232) of the drilling spool (222) is open, and the rig choke line outlet (226) of the drilling spool (222) is open. Furthermore, the bleed off line outlet (228) the MPD choke line outlet (230) of the drilling spool (222) is closed.

In the kill flow path (248), the mud is pumped from the mud conditioning system (212) to the kill line (236) via the mud pumps (214). The mud flows through the kill line (236) into the annulus of the wellbore (102) via the kill line inlet (232) of the drilling spool (222). Mud is removed from the annulus of the wellbore (102) via the rig choke line outlet (226) of the drilling spool (222). The mud flows from the rig choke line outlet (226) into the rig choke line (234). The mud flows through the rig choke line (234) to the rig choke (208) and the rig separator (210). At this point, the mud flows back to the mud conditioning system (212) and is recirculated.

Figure 4:
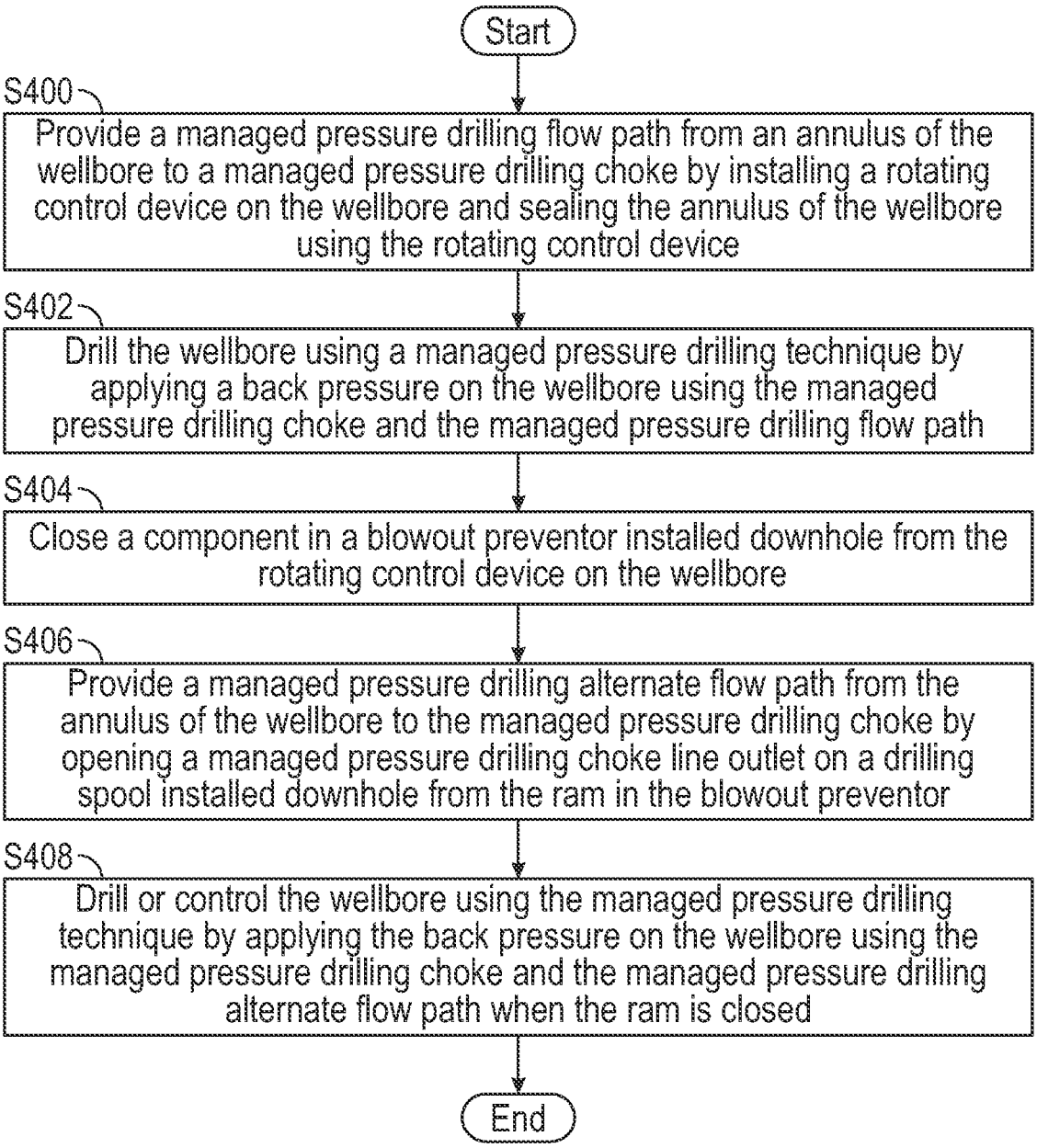
FIG. 4 shows a flowchart in accordance with one or more embodiments.

FIG. 4 shows a flowchart in accordance with one or more embodiments. The flowchart outlines a method for drilling a wellbore (102) using a managed pressure drilling (MPD) technique. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In S400, an MPD flow path (242) is provided from an annulus of the wellbore (102) to an MPD choke (204) by installing an RCD (202) on the wellbore (102) and sealing the annulus of the wellbore (102) using the RCD (202). The MPD flow path (242) hydraulically connects the RCD (202) to the MPD choke (204), the MPD choke (204) to the MPD flow meter (206), the MPD flow meter (206) to the mud conditioning system (212), the mud conditioning system (212) to the mud pumps (214), and the mud pumps (214) to the wellbore (102) via the drill string (108).

In S402, the wellbore (102) is drilled using an MPD technique by applying a back pressure on the wellbore (102) using the MPD choke (204) and the MPD flow path (242). The MPD technique includes controlling the wellbore (102) pressures using the back pressure applied by the MPD choke (204). The MPD choke (204) applies the back pressure through the MPD flow path (242) into the wellbore (102).

In S404, a component is closed in a BOP (216) installed downhole from the RCD (202) on the wellbore (102). The component may be a ram, such as the annular ram (219), double ram (218), lower pipe ram (220), described above, included in the BOP (216) that is located above (i.e., up hole from) the drilling spool (222). Closure of the component in the BOP (216) prevents the mud from circulating above the BOP (216) and through the RCD (202).

In S406, an MPD alternate flow path (244) is provided from the annulus of the wellbore (102) to the MPD choke (204) by opening an MPD choke line outlet (230) on a drilling spool (222) installed downhole from the component in the BOP (216). The MPD alternate flow path (244) hydraulically connects the MPD choke line outlet (230) to the MPD alternate line (238), the MPD alternate line (238) to the MPD primary line (240), the MPD primary line (240) to the MPD choke (204), the MPD choke (204) to the MPD flow meter (206), the MPD flow meter (206) to the mud conditioning system (212), the mud conditioning system (212) to the mud pumps (214), and the mud pumps (214) to the wellbore (102) via the drill string (108).

In S408, the wellbore (102) is drilled or controlled using the MPD technique by applying the back pressure on the wellbore (102) using the MPD choke (204) and the MPD alternate flow path (244) when the component is closed. The MPD choke (204) applies the back pressure through the MPD alternate flow path (244) into the wellbore (102).

In accordance with further embodiments, a rig choke flow path (246) may be provided from the annulus of the wellbore (102) to a rig choke (208) when the component, e.g., annular ram (219), is closed by opening a rig choke line outlet (226) on the drilling spool (222). A kick may be circulated out of the wellbore (102) using the rig choke flow path (246) and the rig choke (208).

The rig choke flow path (246) hydraulically connects the rig choke line outlet (226) to the rig choke line (234), the rig choke line (234) to the rig choke (208), the rig choke (208) to the rig separator (210), the rig separator (210) to the mud conditioning system (212), the mud conditioning system (212) to the mud pumps, and the mud pumps (214) to the wellbore (102) via the drill string (108).

In accordance with one or more embodiments, pressure may be bled off of the drilling spool (222) using a bleed off line outlet (228) located on the drilling spool (222). Further, a kill flow path (248) may be provided from a mud pump (214) to the annulus of the wellbore (102) by opening a kill line inlet (232) on the drilling spool (222). The kill flow path (248) hydraulically connects the mud pumps (214) to the kill line (236) and the kill line (236) to the annulus of the wellbore (102) via the kill line inlet (232).

The kill flow path (248) is used to kill a well by pumping the mud at a mud weight larger than the pressure of the kick. The kill flow path (248) is used when it isn't possible to pump mud through the drill string (108) from the mud pumps (214). When the kill flow path (248) is being used, the rig choke flow path (246) may also be used in conjunction in order to circulate out the kick.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for drilling a wellbore, the system comprising:

a rotating control device installed on the wellbore, configured to seal an annulus of the wellbore, and configured to provide a managed pressure drilling flow path from the annulus of the wellbore to a managed pressure drilling choke;

the managed pressure drilling choke configured to partially close to apply a back pressure on the wellbore to drill the wellbore using a managed pressure drilling technique;

a blowout preventor installed downhole from the rotating control device on the wellbore;

a component located in the blowout preventor and configured to close to prevent mud from flowing to the rotating control device; and a drilling spool installed downhole from the component in the blowout preventor and having a managed pressure drilling choke line outlet configured to provide a managed pressure drilling alternate flow path from the annulus of the wellbore to the managed pressure drilling choke when the component is closed, wherein the managed pressure drilling alternate flow path merges with the managed pressure drilling flow path to go into the same managed pressure drilling choke.

2. The system of claim 1, wherein the drilling spool further comprises a rig choke line outlet configured to provide a rig choke flow path from the annulus of the wellbore to a rig choke when the component is closed.

3. The system of claim 2, wherein the rig choke is configured to circulate a kick out of the wellbore.

4. The system of claim 2, further comprising a mud-gas separator connected to an outlet of the rig choke.

5. The system of claim 2, further comprising a mud conditioning system configured to receive and condition mud from the managed pressure drilling choke and the rig choke.

6. The system of claim 5, further comprising a mud pump configured to pump the mud from the mud conditioning system to a drill string disposed in the wellbore.

7. The system of claim 6, wherein the drill string comprises a drill bit configured to circulate the mud from the drill string into the annulus of the wellbore.

8. The system of claim 1, wherein the drilling spool further comprises a bleed off line outlet configured to allow pressure to be bled from the drilling spool.

9. The system of claim 1, wherein the drilling spool further comprises a kill line inlet configured to provide a kill flow path from a mud pump to the annulus of the wellbore.

10. The system of claim 1, further comprising a flow meter connected to an outlet of the managed pressure drilling choke.

11. A method for drilling a wellbore, the method comprising:

providing a managed pressure drilling flow path from an annulus of the wellbore to a managed pressure drilling choke by installing a rotating control device on the wellbore and sealing the annulus of the wellbore using the rotating control device;

drilling the wellbore using a managed pressure drilling technique by applying a back pressure on the wellbore using the managed pressure drilling choke and the managed pressure drilling flow path;

closing a component in a blowout preventor installed downhole from the rotating control device on the wellbore;

providing a managed pressure drilling alternate flow path from the annulus of the wellbore to the managed pressure drilling choke by opening a managed pressure drilling choke line outlet on a drilling spool installed downhole from the component in blowout preventor, wherein the managed pressure drilling alternate flow path merges with the managed pressure drilling flow path to go into the same managed pressure drilling choke; and drilling or controlling the wellbore using the managed pressure drilling technique by applying the back pressure on the wellbore using the managed pressure drilling choke and the managed pressure drilling alternate flow path when the component is closed.

12. The method of claim 11, further comprising providing a rig choke flow path from the annulus of the wellbore to a rig choke when the component is closed by opening a rig choke line outlet on the drilling spool.

13. The method of claim 12, further comprising circulating a kick out of the wellbore using the rig choke flow path and the rig choke.

14. The method of claim 12, further comprising separating gas from mud flowing from the rig choke using a mud-gas separator.

15. The method of claim 12, further comprising conditioning mud from the managed pressure drilling choke or the rig choke using a mud conditioning system.

16. The method of claim 15, wherein drilling or controlling the wellbore using the managed pressure drilling technique further comprises pumping the mud from the mud conditioning system to a drill string disposed in the wellbore.

17. The method of claim 16, wherein drilling or controlling the wellbore using the managed pressure drilling technique further comprises circulating the mud from the drill string into the annulus of the wellbore using a drill bit.

18. The method of claim 11, further comprising bleeding off pressure from the drilling spool using a bleed off line outlet located on the drilling spool.

19. The method of claim 11, further comprising providing a kill flow path from a mud pump to the annulus of the wellbore by opening a kill line inlet on the drilling spool.

20. The method of claim 11, further comprising controlling a flow of mud from the managed pressure drilling choke using a flow meter.

* * * * *